US006398229B1

(12) United States Patent
Saylor

(10) Patent No.: US 6,398,229 B1
(45) Date of Patent: Jun. 4, 2002

(54) THREE-WHEELED ROLLER SKATE AND METHOD THEREFOR

(76) Inventor: Dean Saylor, 1405 Vegas Valley Dr., #363 Las Vegas, NV (US) 89109

( * ) Notice: Subject to any disclaimer, the term of this patent is extended or adjusted under 35 U.S.C. 154(b) by 0 days.

(21) Appl. No.: 09/618,594

(22) Filed: Jul. 17, 2000

(51) Int. Cl.[7] ..... A63C 17/04; A63C 17/14

(52) U.S. Cl. ..... 280/11.19; 280/11.208; 280/11.27

(58) Field of Search ..... 280/841, 842, 280/11.19, 11.204, 11.206, 11.207, 11.208, 11.222, 11.231, 11.3, 11.27

(56) References Cited

U.S. PATENT DOCUMENTS

| | | | | | |
|---|---|---|---|---|---|
| 153,945 | A | * | 8/1874 | Gregg | 280/11.19 |
| 233,845 | A | * | 11/1880 | Gregg | 280/11.19 |
| 1,066,842 | A | * | 7/1913 | Post | 280/11.115 |
| 1,334,609 | A | * | 3/1920 | Guindon | 280/11.19 |
| 1,632,997 | A | | 6/1927 | Connolly | |
| D81,773 | S | | 8/1930 | Brinkman | |
| 1,784,761 | A | * | 12/1930 | Smith | 280/11.115 |
| 1,854,188 | A | | 4/1932 | Gregory | |
| 2,430,037 | A | * | 11/1947 | Vincent | 280/11.209 |
| 3,086,787 | A | * | 4/1963 | Wyche | 280/11.19 |
| D226,440 | S | | 3/1973 | Bentley | |
| D233,537 | S | | 11/1974 | Horner | |
| 3,871,672 | A | * | 3/1975 | Bardy | 280/11.21 |
| 3,904,215 | A | | 9/1975 | Bardy | |
| D238,803 | S | | 2/1976 | Sessa | |
| 4,298,209 | A | * | 11/1981 | Peters | 280/11.209 |
| 4,394,028 | A | * | 7/1983 | Wheelwright | 280/11.19 |
| 4,417,737 | A | * | 11/1983 | Suroff | 280/11.115 |
| 4,523,767 | A | | 6/1985 | Page | |
| 4,657,265 | A | | 4/1987 | Ruth | |
| 4,709,937 | A | * | 12/1987 | Lin et al. | 280/11.2 |
| 4,817,974 | A | * | 4/1989 | Bergeron | 280/11.209 |
| 4,844,491 | A | | 7/1989 | Wheelwright | |
| 4,966,377 | A | * | 10/1990 | Yu | 280/11.2 |
| D347,044 | S | | 5/1994 | Slack et al. | |
| 5,709,395 | A | * | 1/1998 | Lee | 280/11.204 |
| 5,967,530 | A | * | 10/1999 | Chung | 280/11.19 |
| 6,070,885 | A | * | 6/2000 | Ferone | 280/11.19 |
| 6,082,768 | A | * | 7/2000 | Johnson | 280/842 |

* cited by examiner

*Primary Examiner*—Brian L. Johnson
*Assistant Examiner*—Bridget Avery
(74) *Attorney, Agent, or Firm*—Harry M. Weiss; Jeffrey D. Moy; Weiss & Moy, P.C.

(57) ABSTRACT

A three-wheeled roller skate and method therefore, including a substantially shoe-shaped foot receptacle, two heel end wheels rotatably coupled to an axis, and a toe end wheel smaller in diameter than the two heel end wheels positioned in front of and spaced apart from the toe end of the skater's foot, allowing a user to maximize both stability as well as speed.

4 Claims, 1 Drawing Sheet

THREE-WHEELED ROLLER SKATE AND METHOD THEREFOR

FIELD OF THE INVENTION

This invention relates generally to roller skates and, more specifically, to a three-wheeled roller skate having a substantially shoe-shaped foot receptacle, two heel end wheels rotatably coupled to an axis, and a toe end wheel smaller in diameter than the two heel end wheels and positioned in front of and spaced apart from the toe end of the skater's foot.

BACKGROUND OF THE INVENTION

Roller skates are often used both as a source of recreation as well as a means for personal transportation. Traditional roller skates comprise four wheels, with two wheels parallel each other on either side of the toe end of a platform and two wheels parallel each other on either side of the heel end of the platform. Some roller skates are also designed with a shoe-like foot receptacle to better secure the foot to the platform. Although the four-wheel arrangement is stable, a three-wheel arrangement can provide increased speed through an overall decrease in the amount of friction between the wheels and the ground. Increased maneuverability is also created by this arrangement by decreasing the overall weight of the roller skate and by increasing the turning ability by giving the wearer an increased control over his or her center of gravity. Additionally, a three-wheel arrangement with two wheels disposed parallel each other at either end of an axis located at a center of gravity of the shoe-shaped foot receptacle and only one wheel at the center of the toe end increases stability.

Over the years, some prior art three-wheeled roller skates have been developed. For example, U.S. Pat. No. 4,523,767 issued to Le Page shows a three-wheeled roller skate. This patent shows an axle positioned proximate the heel end of the skate, thus limiting the skater's ability to balance. In addition, this design lacks a shoe-like foot receptacle making it difficult for the wearer to safely secure his or her foot to the skate for optimum skating maneuverability. Additionally, the Le Page skate is designed with the skater's toes directly over the toe end wheel rather than the toe end wheel being positioned in front of and spaced from the toe end of the skater's foot. The Le Page design lacks the stability inherent in a spaced-apart configuration. The larger the area within the triangle created by the three wheels the more stable the skate. A more stable design therefore requires the toe end wheel to be positioned in front of and spaced from the toe end of the skater's foot. The Le Page skate also discloses three wheels of equal diameters, as opposed to two heel wheels larger in diameter than a front toe end wheel to optimize speed.

U.S. Design Pat. No. 266,440 issued to Bentley, U.S. Pat. No. 4,844,491 issued to Wheelwright, and U.S. Pat. No. 1,632,997 issued to Connolly show several additional designs for three-wheeled roller skates. Although differing wheel diameters are shown between the wheels at the heel end and the wheel at the toe end, all of the patents disclose a rear axle proximate the heel end of the skate, limiting the balance of the skater. In addition, the toe end wheel is not positioned in front of and spaced from the toe end of the skater's foot, also limiting the skater's balance. Additionally, none of these patents disclose a shoe-like foot receptacle to secure the skater's foot to the skate in a stable fashion.

Several attempts have been made to create a three-wheeled roller skate which optimizes the design advantage of having the toe end wheel positioned in front of and spaced from the toe end of the skater's foot. U.S. Pat. No. 1,854,188 issued to Gregory, U.S. Design Pat. No. 238,803 issued to Sessa, and U.S. Design Pat. No. 81,773 issued to Brinkman all take advantage of the spaced-apart design. However, none of these patents disclose an axle for the two rear wheels which is fixedly coupled to the bottom of the skate proximate a center of gravity of the skater's foot. In addition, none of the patents disclose a shoe-like foot receptacle or diameter variance between the two heel end wheels and the toe end wheel.

A need therefore existed for a three-wheeled roller skate having the combination of the qualities of: an axle for the two heel end wheels coupled at the bottom of a platform proximate a center of gravity of a shoe-like foot receptacle, two heel end wheels larger in diameter than the toe end wheel to allow for optimum speed, and a design in which the toe end wheel is positioned in front of and spaced apart from the toe end of the skater's foot to maximize stability.

SUMMARY OF THE INVENTION

An object of the present invention is to provide a stable three-wheeled roller skate capable of allowing a skater to securely fasten his or her foot to the skate while at the same time achieving a high rate of speed in a stable fashion.

It is a further object of the present invention to provide a method for roller skating allowing a skater to securely fasten his or her foot to the skate while at the same time achieving a high rate of speed in a stable fashion.

BRIEF DESCRIPTION OF THE PREFERRED EMBODIMENTS

In accordance with one embodiment of the present invention, a roller skate is disclosed, comprising, in combination, a platform having a top portion and a bottom portion and a first end and a second end and a first side and a second side, a substantially shoe-shaped foot receptacle having a heel end and a toe end, the foot receptacle is fixedly coupled to the top portion of the platform with the heel end of the foot receptacle coupled proximate the first end of the platform and the toe end of the foot receptacle coupled proximate the second end of the platform, an axle having a first end and a second end, the axle is fixedly coupled to the bottom portion of the platform proximate a center of gravity of the shoe-shaped foot receptacle, a first wheel rotatably coupled to the first end of the axle proximate the first side of the platform, a second wheel having substantially the same shape and diameter of the first wheel rotatably coupled to the second end of the axle proximate the second side of the platform and substantially parallel to the first wheel, a third wheel smaller in diameter than the first and second wheels rotatably coupled proximate the second end of the platform, the third wheel is in front of and spaced from the toe end of the shoe receptacle, and a braking device fixedly coupled to the bottom portion of the platform proximate the first end.

In accordance with another embodiment of the present invention, a roller skate is disclosed, comprising, in combination, a first horizontal platform having a top portion and a bottom portion and a first end and a second end and a first side and a second side, a vertical platform having a top end a bottom end, the bottom end is fixedly coupled to the second end of the first horizontal platform, a second horizontal platform having a first end and a second end, the first end of the second horizontal platform is fixedly coupled to the top end of the vertical platform, a substantially shoe-shaped foot receptacle having a heel end and a toe end, the foot receptacle is fixedly coupled to the top portion of the first horizontal platform with the heel end of the foot receptacle coupled proximate the first end of the first horizontal platform and the toe end of the foot receptacle coupled proximate the second end of the first horizontal platform, an axle having a first end and a second end, the axle is fixedly coupled to the bottom portion of the first horizontal platform proximate a center of gravity of the shoe-shaped foot receptacle, a first wheel rotatably coupled to the first end of the axle proximate the first side of the first horizontal platform, a second wheel having substantially the same shape and diameter of the first wheel rotatably coupled to the second end of the axle proximate the second side of the first horizontal platform and substantially parallel to the first wheel, a third wheel smaller in diameter than the first and second wheels rotatably coupled proximate the second end of the second horizontal platform, the third wheel is in front of and spaced from the toe end of the shoe receptacle, and a braking device fixedly coupled to the bottom portion of the first horizontal platform proximate the first end of the first horizontal platform.

In accordance with yet another embodiment of the present invention, a method for skating is disclosed, comprising, in combination, the steps of providing a platform having a top portion and a bottom portion and a first end and a second end and a first side and a second side, providing a substantially shoe-shaped foot receptacle having a heel end and a toe end, the foot receptacle is fixedly coupled to the top portion of the platform with the heel end of the foot receptacle coupled proximate the first end of the platform and the toe end of the foot receptacle coupled proximate the second end of the platform, providing an axle having a first end and a second end, the axle is fixedly coupled to the bottom portion of the platform proximate a center of gravity of the shoe-shaped foot receptacle, rotatably coupling a first wheel to the first end of the axle proximate the first side of the platform, rotatably coupling a second wheel having substantially the same shape and diameter of the first wheel to the second end of the axle proximate the second side of the platform and substantially parallel to the first wheel, rotatably coupling a third wheel smaller in diameter than the first and second wheels proximate the second end of the platform, the third wheel is in front of and spaced from the toe end of the shoe receptacle, and fixedly coupling a braking device to the bottom portion of the platform proximate the first end.

In accordance with still another embodiment of the present invention, a method for skating is disclosed, comprising, in combination, the steps of providing a first horizontal platform having a top portion and a bottom portion and a first end and a second end and a first side and a second side, providing a vertical platform having a top end and a bottom end, the bottom end is fixedly coupled to the second end of the first horizontal platform, providing a second horizontal platform having a first end and a second end, the first end of the second horizontal platform is fixedly coupled to the top end of the vertical platform, providing a substantially shoe-shaped foot receptacle having a heel end and a toe end, the foot receptacle is fixedly coupled to the top portion of the first horizontal platform with the heel end of the root receptacle coupled proximate the first end of the first horizontal platform and the toe end of the foot receptacle coupled proximate the second end of the first horizontal platform, providing an axle having a first end and a second end, the axle is fixedly coupled to the bottom portion of the first horizontal platform proximate a center of gravity of the shoe-shaped foot receptacle, rotatably coupling a first wheel to the first end of the axle proximate the first side of the first horizontal platform, rotatably coupling a second wheel having substantially the same shape and diameter of the first wheel to the second end of the axle proximate the second side of the first horizontal platform and substantially parallel to the first wheel, rotatably coupling a third wheel smaller in diameter than the first and second wheels proximate the second end of the second horizontal platform, the third wheel is in front of and spaced from the toe end of the shoe receptacle, and fixedly coupling a braking device to the bottom portion of the first horizontal platform proximate the first end of the first horizontal platform.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
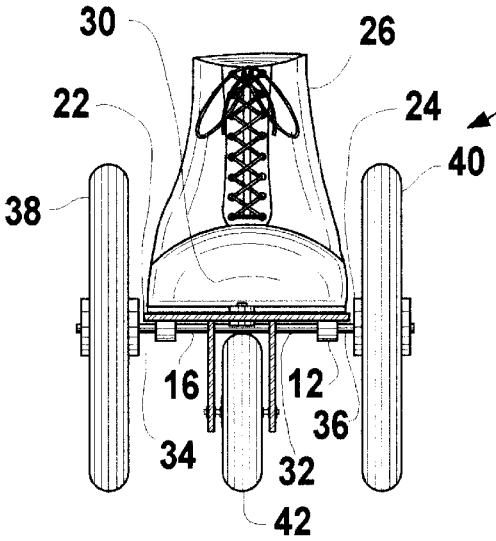
FIG. 1 is an end view of an embodiment of the three-wheeled roller skate of the present invention.
Figure 2:
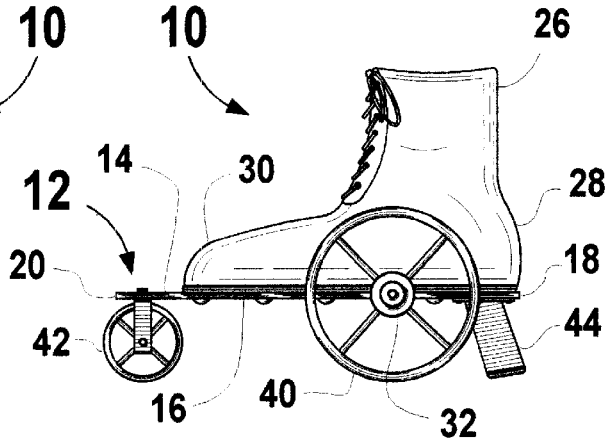
FIG. 2 is a side view of the three-wheeled roller skate of FIG. 1.

Referring to FIGS. 1 and 2 reference number 10 refers generally to one embodiment of the three-wheeled roller skate of the present invention. The three-wheeled roller skate 10 comprises a platform 12 having a top portion 14 (shown in FIG. 2) and a bottom portion 16. The platform 12 also comprises a first end 18 (shown in FIG. 2), a second end 20 (shown in FIG. 2), a first side 22 (shown in FIG. 1) and a second side 24 (shown in FIG. 1).

Still referring to FIGS. 1 and 2, the roller skate 10 also comprises a substantially shoe-shaped foot receptacle 26 having a heel end 28 (shown in FIG. 2) and a toe end 30. The foot receptacle 26 is fixedly coupled to the top portion 14 of the platform 12 with the heel end 28 coupled proximate the first end 18 of the platform 12 and the toe end 30 coupled proximate the second end 20 of the platform 12.

Still referring to FIGS. 1 and 2, the roller skate 10 further comprises an axle 32 (shown in FIG. 1). The axle 32 has a first end 34 (shown in FIG. 1) and a second end 36. The axle 32 is coupled to the bottom portion 16 of the platform 12 proximate a center of gravity of the shoe-shaped foot receptacle 26.

Still referring to FIGS. 1 and 2, a first wheel 38 (shown in FIG. 1) is rotatably coupled to the first end 34 of the axle 32 proximate the first side 22 of the platform 12. A second wheel 40 having substantially the same shape and diameter of the first wheel 38 is rotatably coupled to the second end 36 of the axle 32 proximate the second side 24 of the platform 12. The second wheel 40 is disposed substantially parallel to the first wheel 38. The roller skate 10 also comprises a third wheel 42, smaller in diameter than the first wheel 38 and the second wheel 40. The third wheel 42 is rotatably coupled proximate the second end 20 of the platform 12. The third wheel 42 is in front of and spaced from the toe end 30 of the foot receptacle 26.

Referring now to FIG. 2, a braking device 44 is fixedly coupled to the bottom portion 16 of the platform 12 proximate the first end 18. Preferably, the braking device 44 is constructed of a rubber-type material, although any material which allows the wearer of the roller skate 10 to create friction in order to slow down will be within the spirit and scope of this invention.

Figure 3:
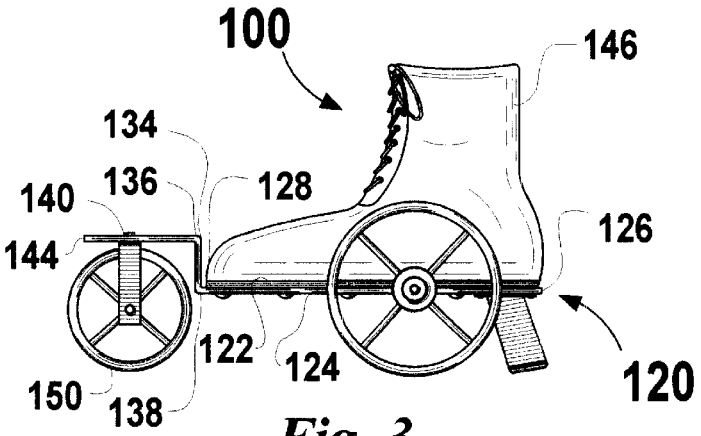
FIG. 3 is a side view of another embodiment of the three-wheeled roller skate of the present invention.
Figure 4:
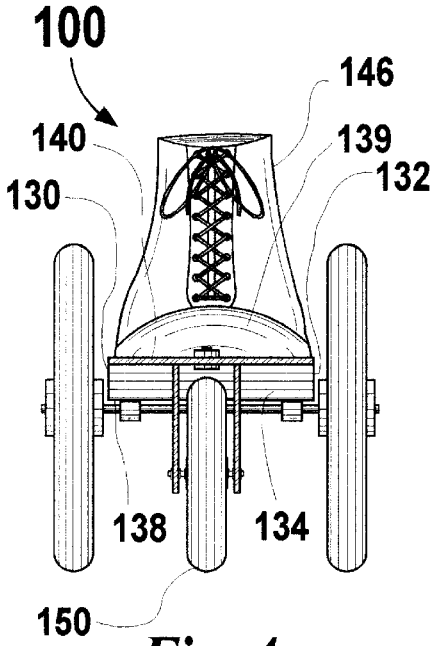
FIG. 4 is an end view of the three-wheeled roller skate of FIG. 3.

Referring now to FIGS. 3 and 4, an alternative embodiment of the three-wheeled roller skate 10, hereinafter 100, is shown. The three-wheeled roller skate 100 is essentially the same as before, although instead of a single platform 12 (shown in FIGS. 1 and 2) the roller skate 100 comprises three platforms.

Referring now to FIG. 3, the roller skate 100 comprises a first horizontal platform 120 having a top portion 122 and a bottom portion 124. The first horizontal platform 120 also comprises a first end 126, a second end 128, a first side 130 (shown in FIG. 4), and a second side 132 (shown in FIG. 4).

Still referring to FIGS. 3 and 4, the roller skate 100 further comprises a vertical platform 134 having a top end 136 (shown in FIG. 3) and a bottom end 138. The bottom end 138 of the vertical platform 134 is fixedly coupled to the second end 128 of the first horizontal platform 120. Preferably, the vertical platform 134 is fixedly coupled to the first horizontal platform at a substantially 90 degree angle, although it should be clearly understood that substantial benefit could also be provided from a coupling angle which deviates, even substantially, from the preferred angle in either direction.

The roller skate 100 also comprises a second horizontal platform 140 having a first end 142 (shown in FIG. 3) and a second end 144 (shown in FIG. 3). The first end 142 of the second horizontal platform 140 is fixedly coupled to the top end 136 of the vertical platform 134.

The roller skate 100 further comprises a substantially shoe-shaped foot receptacle 146, which is essentially the same as the substantially shoe-shaped foot receptacle 26 described in the roller skate 10, although in the roller skate 100, the toe end 139 of the foot receptacle 146 is coupled proximate both the second end 128 of the first horizontal platform 120 as well proximate the vertical platform 134.

The roller skate 100 comprises three wheels in essentially the same arrangement as the roller skate 10, although in the roller skate 100 the third wheel 150 is rotatably coupled proximate the second end 144 of the second horizontal platform 140.

While the invention has been particularly shown and described with reference to preferred embodiments thereof, it will be understood by those skilled in the art that the foregoing and other changes in form and details may be made therein without departing from the spirit and scope of the invention.

I claim:

1. A three wheel roller skate comprising, in combination:

a first horizontal platform having a top portion and a bottom portion and a first end and a second end and a first side and a second side;

a vertical platform having a top end and a bottom end, said bottom end is fixedly coupled to said second end of said first horizontal platform;

a second horizontal platform having a first end and a second end, said first end of said second horizontal platform is fixedly coupled to said top end of said vertical platform;

a substantially shoe-shaped foot receptacle having a heel end and a toe end, said foot receptacle having a foot receiving portion having a front portion and a back portion and is fixedly coupled to said top portion of said first horizontal platform with said heel end of said foot receptacle coupled proximate said first end of said first horizontal platform and said toe end of said foot receptacle coupled proximate said second end of said first horizontal platform;

an axle having a first end and a second end, said axle is fixedly coupled to said bottom portion of said first horizontal platform proximate a center of gravity of said shoe-shaped foot receptacle below and closer to said rear portion than said front portion of said foot receptacle;

a first wheel rotatably coupled to said first end of said axle proximate said first side of said first horizontal platform;

a second wheel having substantially the same shape and diameter of said first wheel rotatably coupled to said second end of said axle proximate said second side of said first horizontal platform and substantially parallel to said first wheel;

a third wheel smaller in diameter than said first and second wheels rotatably coupled to said second horizontal platform proximate said second end of said second horizontal platform, said third wheel is in front of and spaced from said toe end of said shoe receptacle, a bottom surface portion of said third wheel is in horizontal alignment with a bottom surface portion of both said first wheel and said second wheel to maintain said first horizontal platform parallel to ground during use of the three wheel roller skate; and a braking device fixedly coupled to said bottom portion of said first horizontal platform proximate said first end of said first horizontal platform.

2. The three wheel roller skate of claim 1 wherein said braking device comprises a rubber-type material.

3. A method of forming a three wheel roller skate, comprising, in combination the steps of:

providing a first horizontal platform having a top portion and a bottom portion and a first end and a second end and a first side and a second side;

providing a vertical platform having a top end and a bottom end, said bottom end is fixedly coupled to said second end of said first horizontal platform;

providing a second horizontal platform having a first end and a second end, said first end of said second horizontal platform is fixedly coupled to said top end of said vertical platform;

providing a substantially shoe-shaped foot receptacle having a heel end and a toe end, said foot receptacle having a foot receiving portion having a front portion and a back portion and is fixedly coupled to said top portion of said first horizontal platform with said heel end of said foot receptacle coupled proximate said first end of said first horizontal platform and said toe end of said foot receptacle coupled proximate said second end of Said first horizontal platform;

providing an axle having a first end and a second end, said axle is fixedly coupled to said bottom portion of said first horizontal platform proximate a center of gravity of said shoe-shaped foot receptacle below and closer to said rear portion than said front portion of said foot receptacle;

rotatably coupling a first wheel to said first end of said axle proximate said first side of said first horizontal platform;

rotably coupling a second wheel having substantially the same shape and diameter of said first wheel to said second end of said axle proximate said second side of said first horizontal platform and substantially parallel to said first wheel;

rotatably coupling a third wheel smaller in diameter than said first and second wheels to said second horizontal platform proximate said second end of said second horizontal platform, said third wheel is in front of and spaced from said toe end of said shoe receptacle, a bottom surface portion of said third wheel is in horizontal alignment with a bottom surface portion of both said first wheel and said second wheel to maintain said first horizontal platform parallel to ground during use of the three wheel roller skate; and fixedly coupling a braking device to said bottom portion of said first horizontal platform proximate said first end of said first horizontal platform.

4. The method of claim 3 wherein said braking device comprises a rubber type material.

* * * * *